US007785537B2

(12) United States Patent
Ohashi

(10) Patent No.: US 7,785,537 B2
(45) Date of Patent: Aug. 31, 2010

(54) SAMPLE CONTAINER

(75) Inventor: Naoki Ohashi, Tokyo (JP)

(73) Assignee: Beckman Coulter, Inc., Brea, CA (US)

( * ) Notice: Subject to any disclaimer, the term of this patent is extended or adjusted under 35 U.S.C. 154(b) by 164 days.

(21) Appl. No.: 12/025,418

(22) Filed: Feb. 4, 2008

(65) Prior Publication Data

US 2008/0226506 A1 Sep. 18, 2008

Related U.S. Application Data

(63) Continuation of application No. PCT/JP2006/315321, filed on Aug. 2, 2006.

(30) Foreign Application Priority Data

Aug. 4, 2005 (JP) ..... 2005-226998

(51) Int. Cl.

| | |
|---|---|
| ***B01L 3/00*** | (2006.01) |
| ***B65D 51/18*** | (2006.01) |
| ***B65D 41/00*** | (2006.01) |
| ***B65D 43/00*** | (2006.01) |
| ***B65D 51/00*** | (2006.01) |
| *B65D 41/04* | (2006.01) |
| *B65D 53/00* | (2006.01) |

(52) U.S. Cl. ..... 422/102; 220/253; 220/254.1; 220/288; 215/235; 215/329; 215/341

(58) Field of Classification Search ..... 422/102; 220/254.1

See application file for complete search history.

(56) References Cited

U.S. PATENT DOCUMENTS

| | | | | |
|---|---|---|---|---|
| 6,265,225 | B1 | 7/2001 | Otto et al. | |
| 2004/0126278 | A1 * | 7/2004 | Takahashi et al. | 422/99 |
| 2004/0256421 | A1 * | 12/2004 | Werth | 222/480 |
| 2006/0120922 | A1 * | 6/2006 | Matsumoto | 422/64 |

FOREIGN PATENT DOCUMENTS

| | | |
|---|---|---|
| JP | 58/29950 | 2/1993 |
| JP | 11-194132 | 7/1999 |
| JP | 2007040898 A * | 2/2007 |

* cited by examiner

*Primary Examiner*—Jill Warden
*Assistant Examiner*—Jennifer Wecker
(74) *Attorney, Agent, or Firm*—Townsend and Townsend and Crew LLP

(57) ABSTRACT

A sample container includes a cap that covers a container body holding a liquid sample containing a reagent and a test body. The cap includes an outer lid that covers the container body, an inner lid that is slidably attached to the outer lid and has an opening for dispensing the liquid sample, a shutter that is driven integrally with the inner lid and covers the opening of the inner lid so that the opening can be opened and closed, a translating unit that is attached to the outer lid and has an engaging portion which is formed obliquely descending from a center of the cap to an outer edge of the cap and to which the shutter is fitted, and a pressing member that is arranged between the outer lid and the inner lid to press the inner lid to close the shutter, wherein the translating unit translates sliding movement of the inner lid to a movement of the shutter in a direction perpendicular to the sliding movement to open and close the opening of the inner lid.

2 Claims, 14 Drawing Sheets

SAMPLE CONTAINER

CROSS-REFERENCE TO RELATED APPLICATIONS

This application is a continuation of PCT international application Ser. No. PCT/JP2006/315321 filed Aug. 2, 2006 which designates the United States, incorporated herein by reference, and which claims the benefit of priority from Japanese Patent Application No. 2005-226998, filed Aug. 4, 2005, and all incorporated herein by reference.

BACKGROUND OF THE INVENTION

1. Field of the Invention

The present invention relates to a sample container which includes a cap that covers a container holding a liquid sample containing a reagent and a test body to suppress evaporation of the liquid sample.

2. Description of the Related Art

Conventionally, a sample container has a cap covering a container to suppress the evaporation of a contained liquid sample containing a reagent and a test body, and one known reagent container has a lid which rotates laterally upward from a cap-sealing position (see, for example Japanese Patent Application Laid-Open No. H11-194132).

SUMMARY OF THE INVENTION

A sample container according to one aspect of the present invention includes a cap that covers a container body holding a liquid sample containing a reagent and a test body, the cap including, an outer lid that covers the container body, an inner lid that is slidably attached to the outer lid and has an opening for dispensing the liquid sample, a shutter that is driven integrally with the inner lid and covers the opening of the inner lid so that the opening can be opened and closed, a translating unit that is attached to the outer lid and has an engaging portion which is formed obliquely descending from a center of the cap to an outer edge of the cap and to which the shutter is fitted, and a pressing member that is arranged between the outer lid and the inner lid to press the inner lid to close the shutter, wherein the translating unit translates sliding movement of the inner lid to a movement of the shutter in a direction perpendicular to the sliding movement to open and close the opening of the inner lid.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
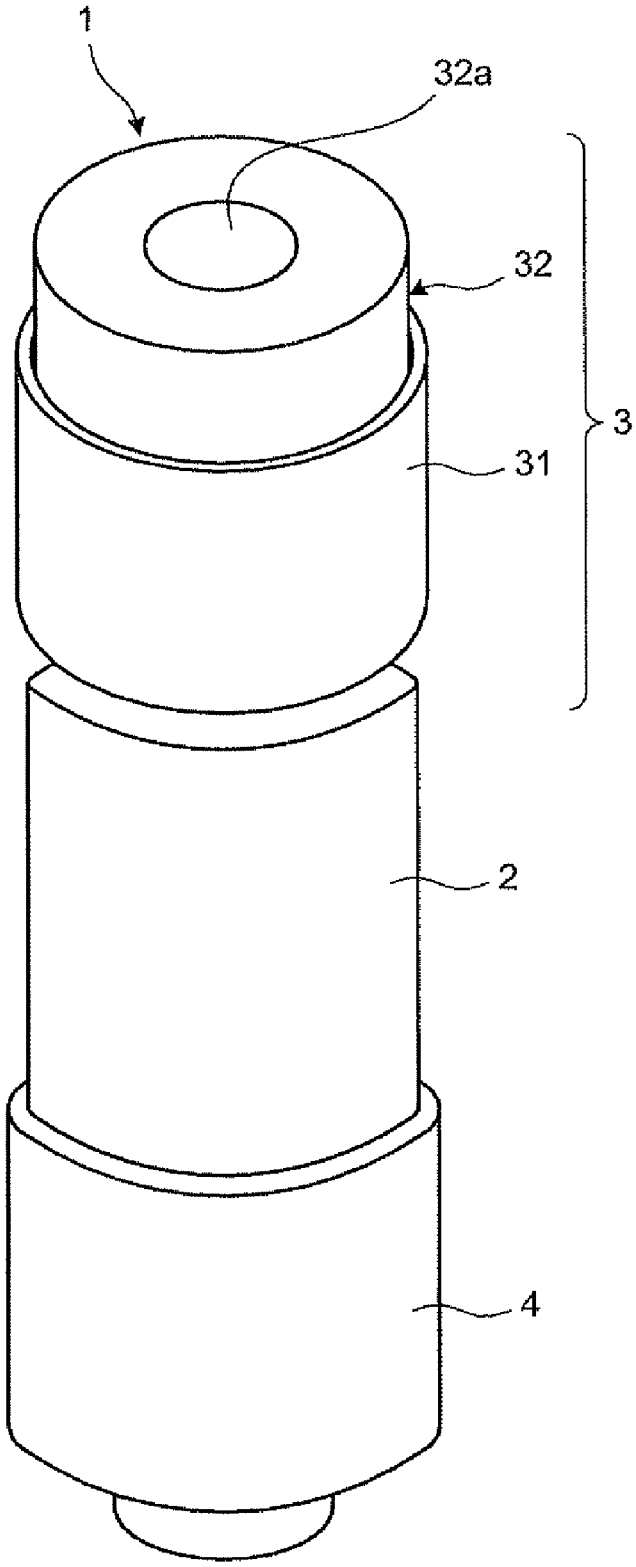
FIG. 1 is a perspective view of a sample container according to the present invention.
Figure 2:
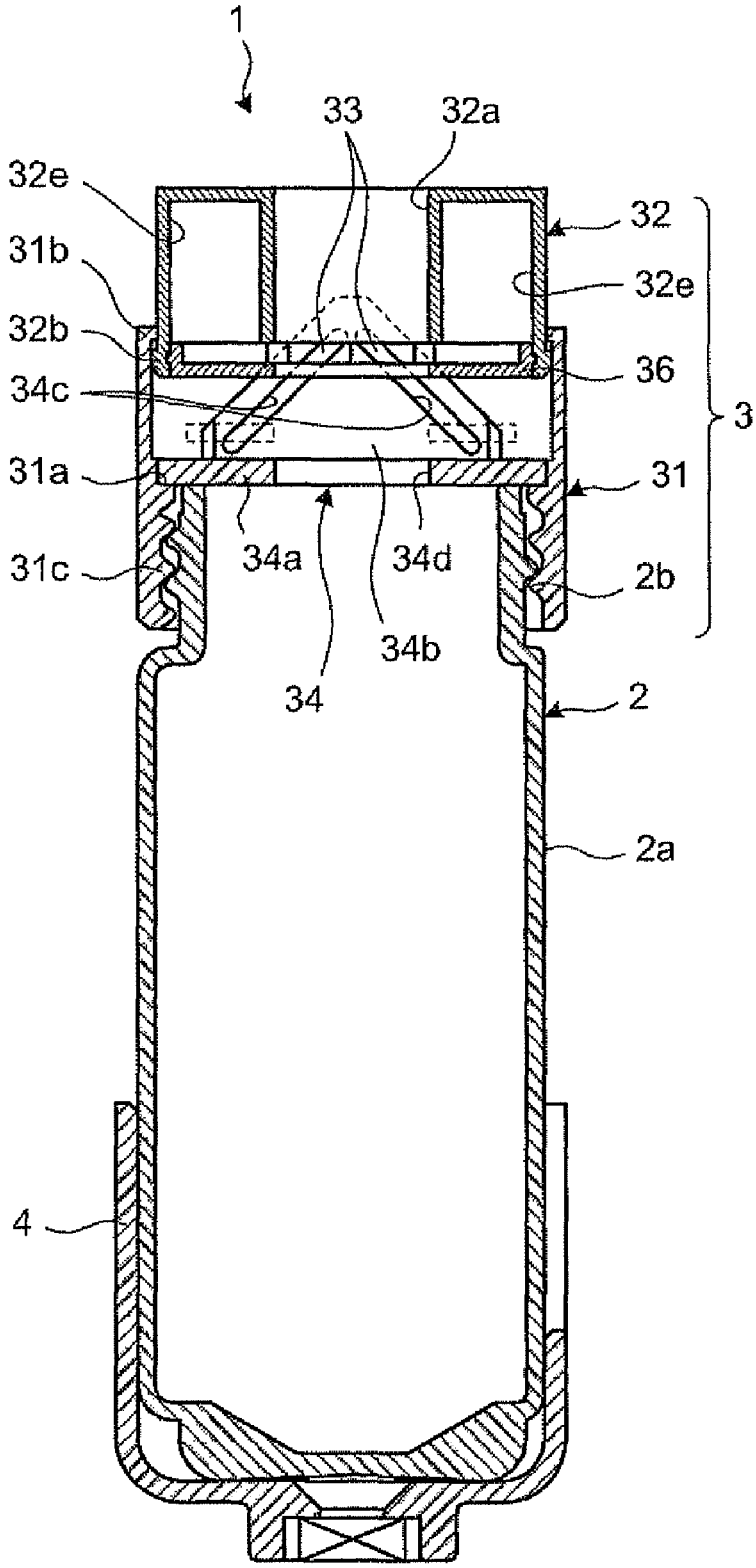
FIG. 2 is a sectional elevation view of the sample container shown in FIG. 1.
Figure 3:
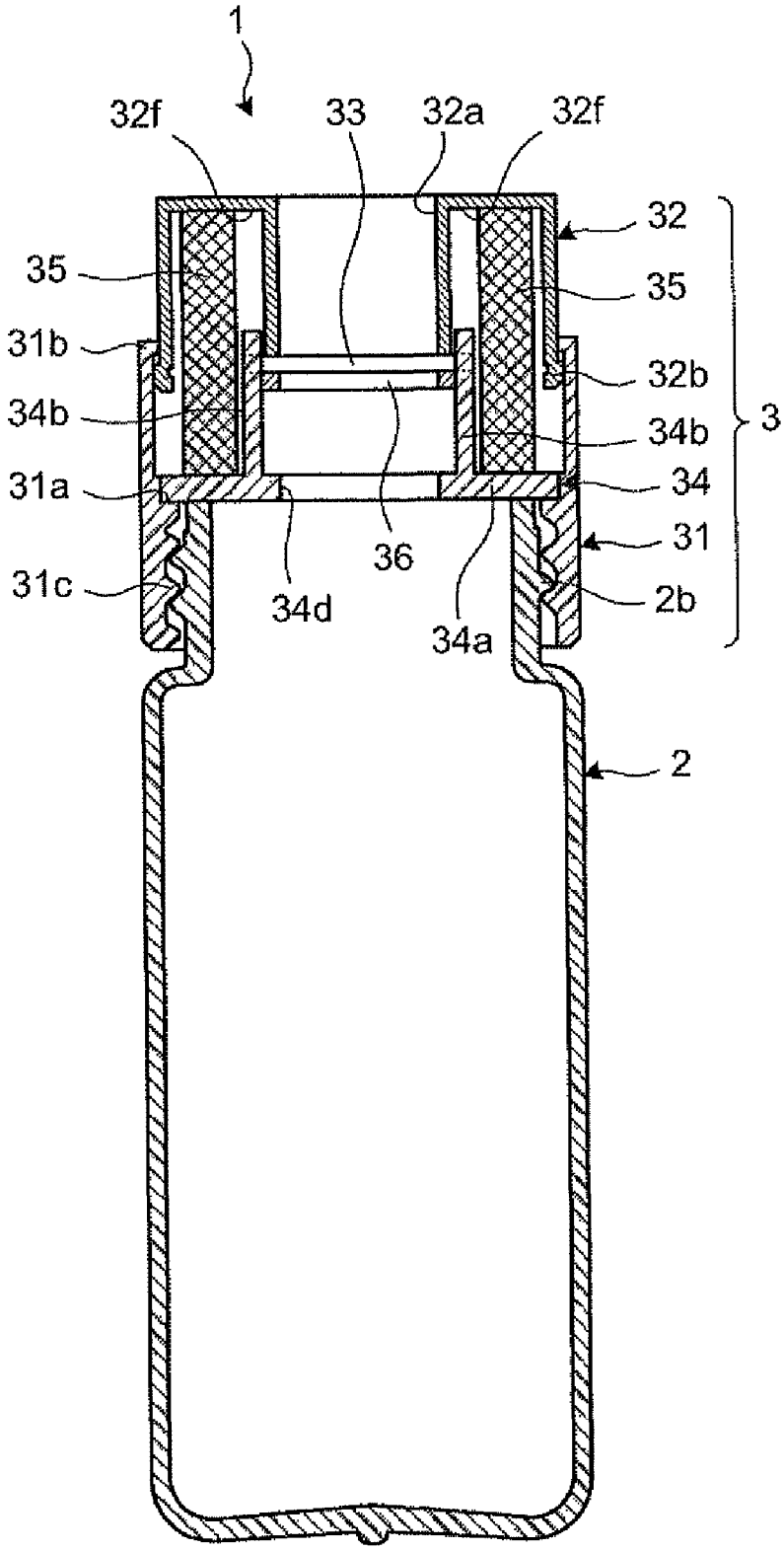
FIG. 3 is a sectional side view of the sample container of FIG. 1 with a cover removed.

Exemplary embodiments of a sample container according to the present invention will be described in detail below with reference to the accompanying drawings. FIG. 1 is a perspective view of the sample container according to the present invention. FIG. 2 is a sectional elevation view of the sample container shown in FIG. 1. FIG. 3 is a sectional side view of the sample container of FIG. 1 with a cover removed.

As shown in FIGS. 1 to 3, a sample container 1 includes a container body 2, a cap 3 covering an upper portion of the container body 2, and a cover 4 attached to a lower portion of the container body 2. As shown in FIG. 2, the container body 2 is substantially cylindrical in shape, and includes a flat portion 2*a* formed on a part of a side surface for label attachment, and a male screw portion 2*b* of a smaller diameter in an upper portion. The cover 4 is cut out in a portion corresponding to the flat portion 2*a* where a label is attached.

The cap 3 includes, as shown in FIGS. 2 and 3, an outer lid 31, an inner lid 32, shutters 33, a translating unit 34, and pressing members 35.

Figure 4:
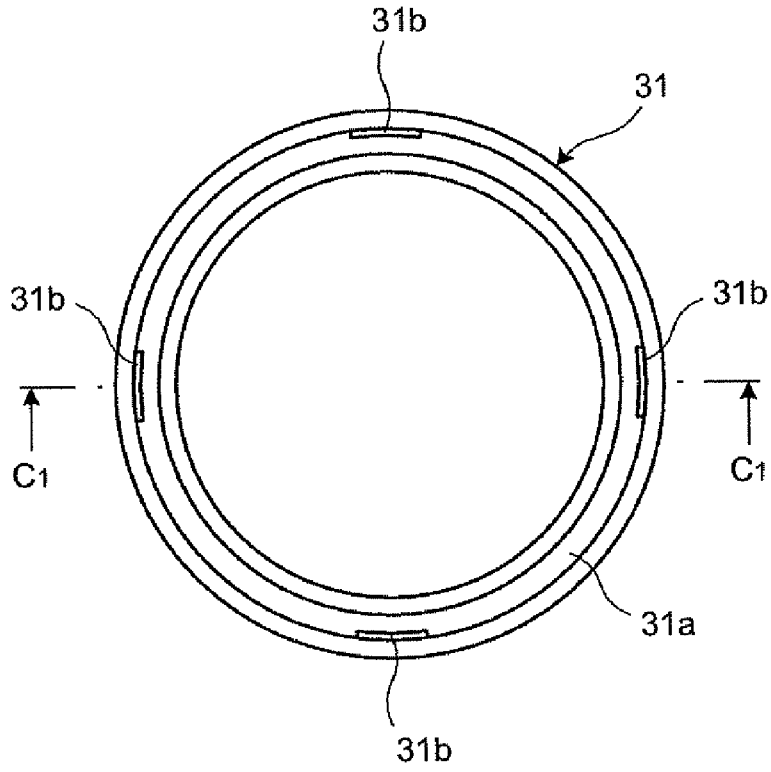
FIG. 4 is a plan view of an outer lid of the sample container of FIG. 1.
Figure 5:
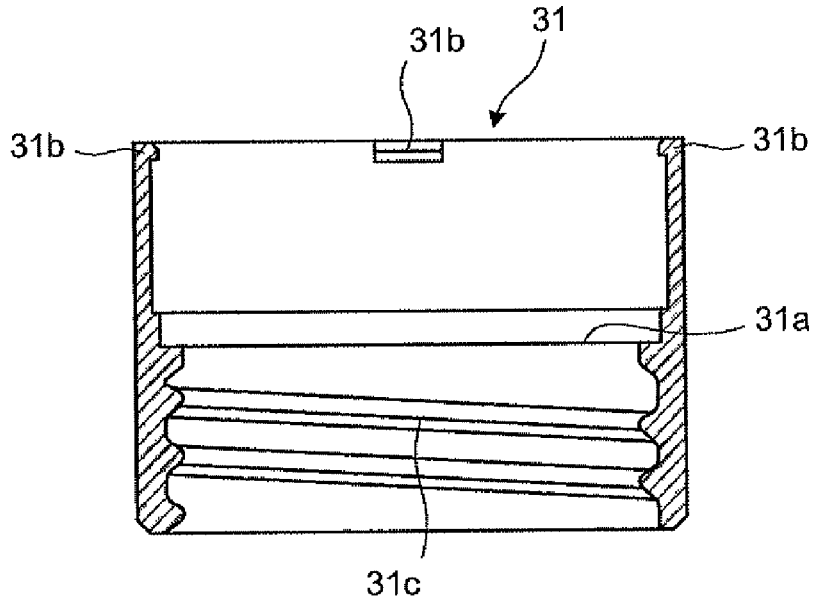
FIG. 5 is a sectional view of the outer lid along line C1-C1 of FIG. 4.

The outer lid 31 is a cylindrical member covering the male screw portion 2*b* of the container body 2, and has a step 31*a* on an inner circumference at a substantially vertically central position as shown in FIGS. 4 and 5. The outer lid 31 has four bosses 31*b* formed at equal intervals along a circumferential direction on an upper portion of the inner circumference. The outer lid 31 further includes a female screw portion 31*c* on the inner circumference below the step 31*a*. The female screw portion 31*c* is screwed onto the male screw portion 2*b*.

Figure 6:
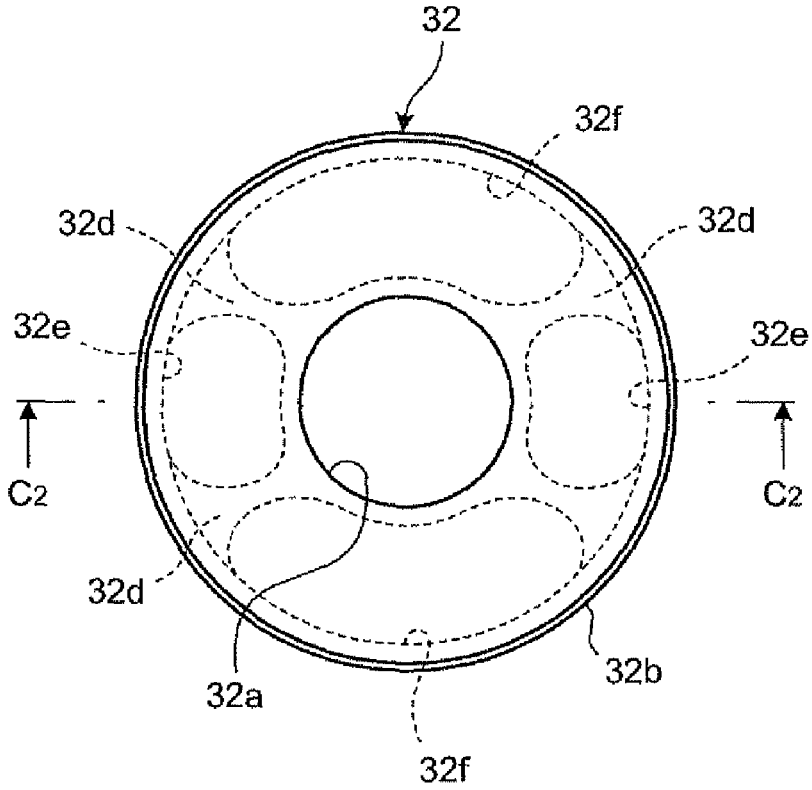
FIG. 6 is a plan view of an inner lid of the sample container shown in FIG. 1.
Figure 7:
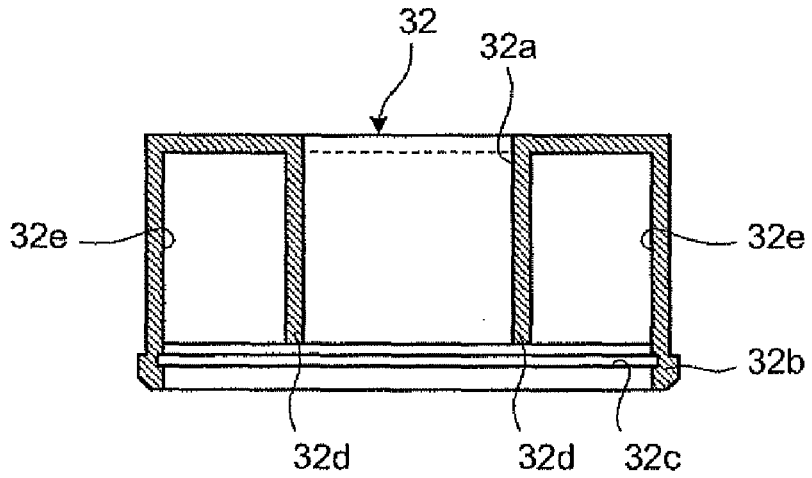
FIG. 7 is a sectional view of the inner lid along line C2-C2 of FIG. 6.

The inner lid 32 is fitted to the outer lid 31 in a vertically slidable manner. The inner lid 32 has an opening 32*a* in a central portion for dispensing a liquid sample as shown in FIGS. 6 and 7. The inner lid 32 has a flange 32*b* formed along a circumferential direction on a lower outer circumference. The flange 32*b* works as a retainer by engaging with the four bosses 31*b* formed on the outer lid 31. The inner lid 32 additionally has an engaging groove 32*c* formed in the circumferential direction on an inner circumference at a position corresponding to the flange 32*b*. The inner lid 32 has two spaces 32*e* and two spaces 32*f* divided by partitions 32*d* and the bottom sides of the spaces 32*e* and 32*f* are open. When the inner lid 32 slides vertically, support plates 34*b* of the translating unit 34 is stored in the spaces 32*f*.

Figure 8:
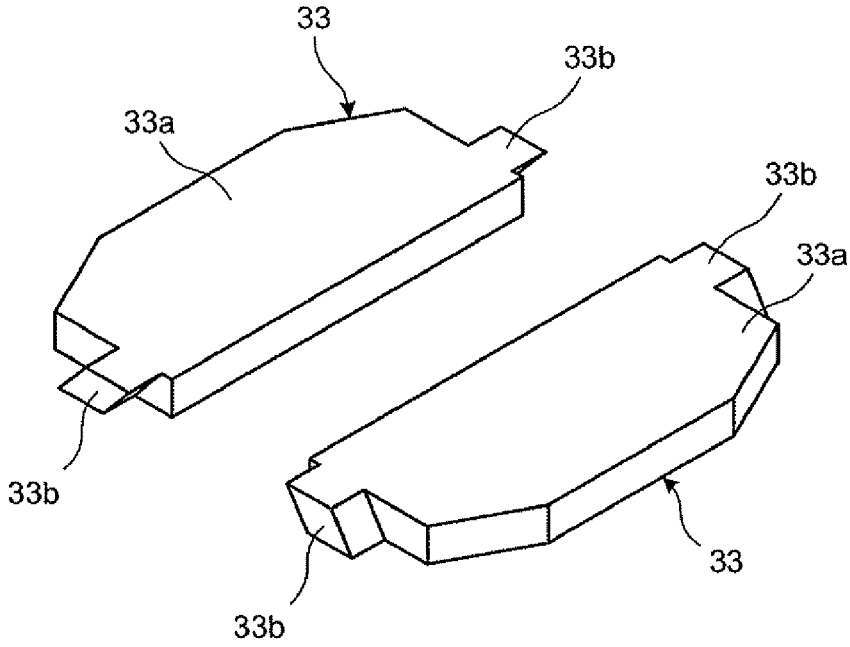
FIG. 8 is a perspective view of two shutters of the sample container of FIG. 1 arranged opposite to each other.

The shutters 33 are plates which cover the opening 32*a* of the inner lid 32 in a manner that the opening 32*a* can be opened and closed. The shutters 33 are driven integrally with the inner lid 32. As shown in FIG. 8, the shutter 33 has square-pole-like bosses 33*b* each having a parallelogrammatic cross section respectively on two sides of a main portion 33*a*. Two shutters 33 are used as a set.

Figure 9:
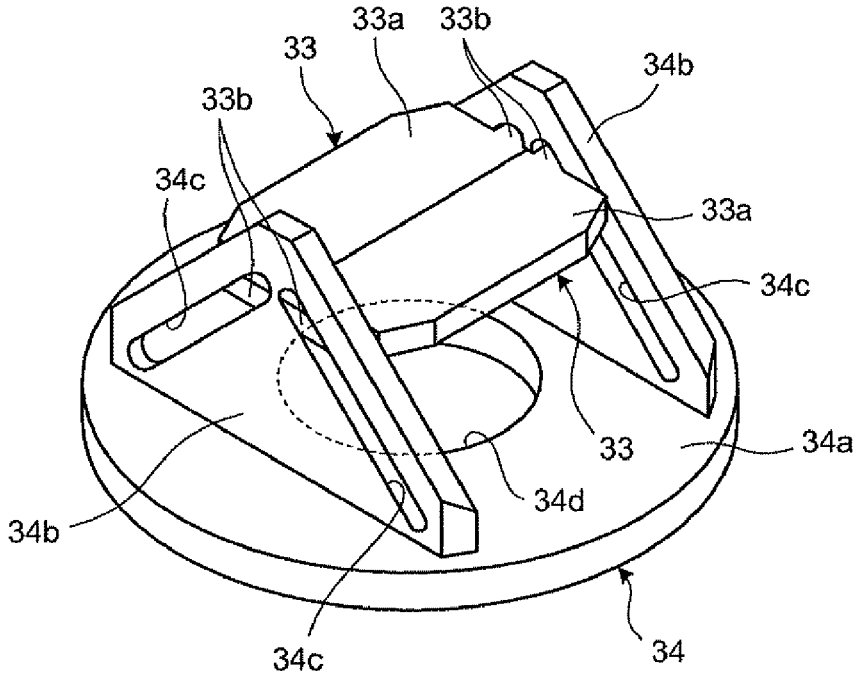
FIG. 9 is a perspective view of a translating unit to which two shutters are fitted.
Figure 10:
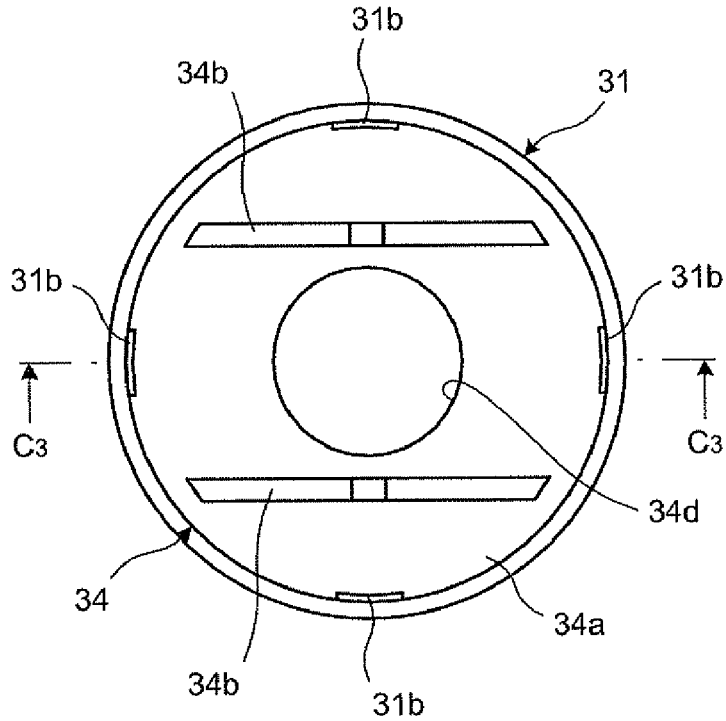
FIG. 10 is a plan view of the outer lid to which the translating unit is fitted.
Figure 11:
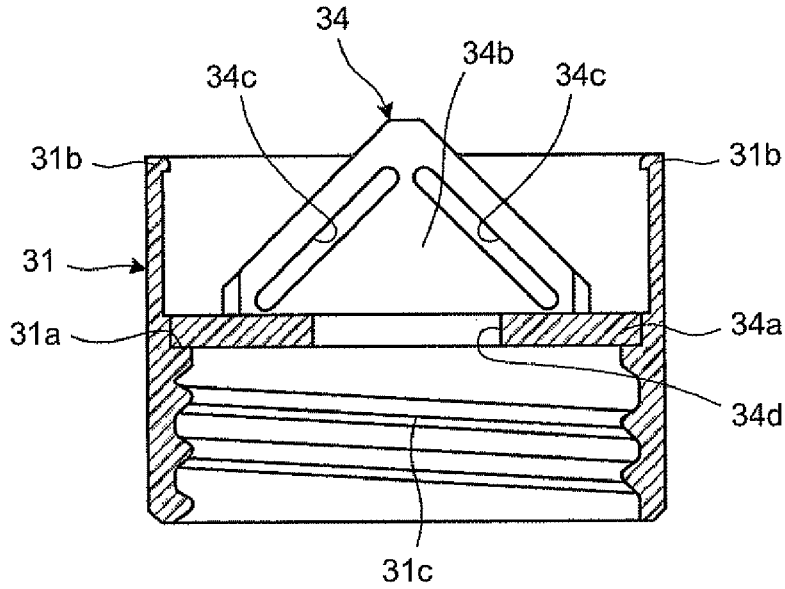
FIG. 11 is a sectional view of the outer lid along line C3-C3 of FIG. 10.

The translating unit 34 is fitted to the outer lid 31 and translates the sliding movements of the inner lid 32 against the outer lid 31 to the horizontal movements of the shutters 33 so as to open and close the opening 32*a*. In the translating unit 34, as shown in FIG. 9, substantially triangular support plates 34*b* are arranged parallel with each other with a predetermined distance therebetween on a disk-like base plate 34*a*. Each of the support plates 34*b* has two guiding slots 34*c* each of which runs obliquely from an upper central portion toward a lower outer edge. The translating unit 34 has an opening 34*d* at the center for dispensing the liquid sample. In the translating unit 34, the shutters 33 are fitted to the two support plates 34*b* with the bosses 33*b* fit into the mutually opposing guiding slots 34*c* in a slidable manner. After the shutters 33 are fitted, the translating unit 34 is fixed to the outer lid 31 with an adhesive or the like with the base plate 34*a* abutted against the step 31*a* as shown in FIGS. 10 and 11.

Figure 12:
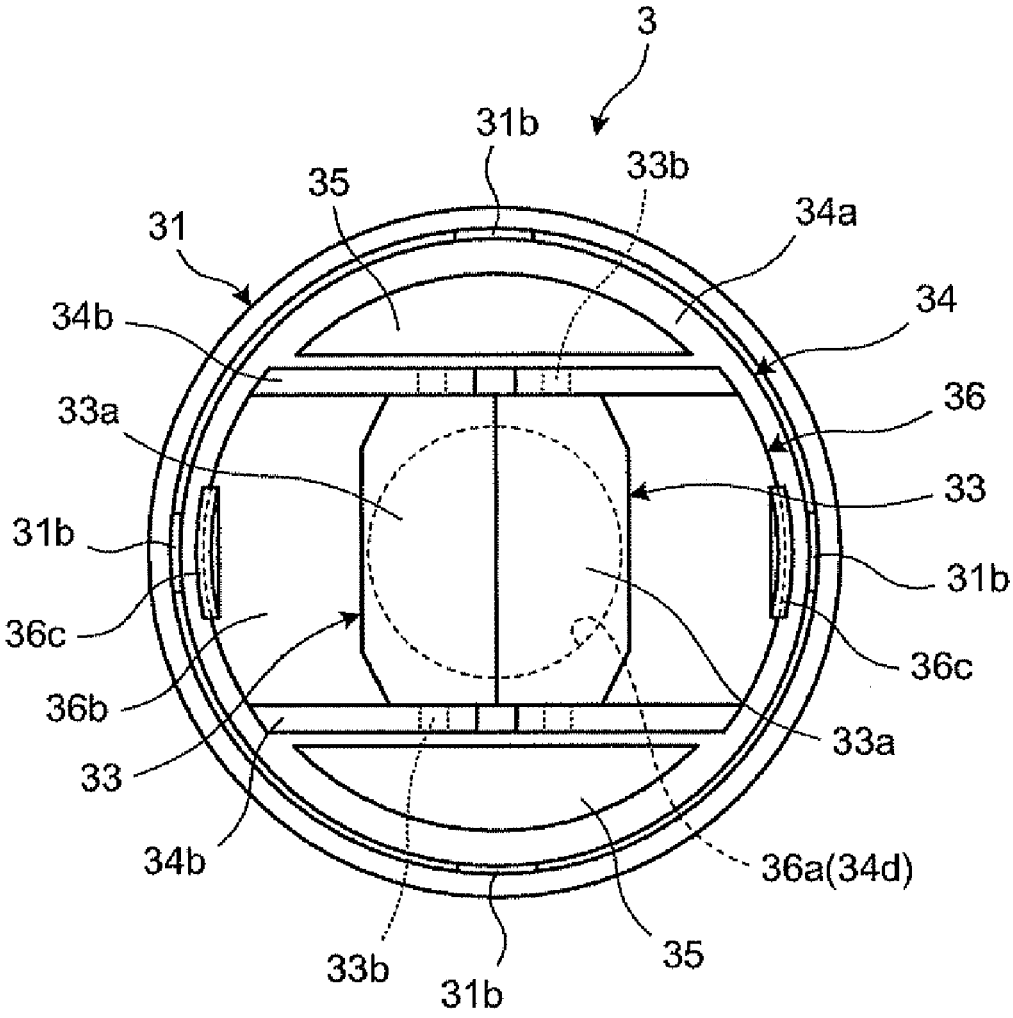
FIG. 12 is a plan view of a cap portion of the sample container shown in FIG. 2 from which an upper lid is removed.
Figure 13:
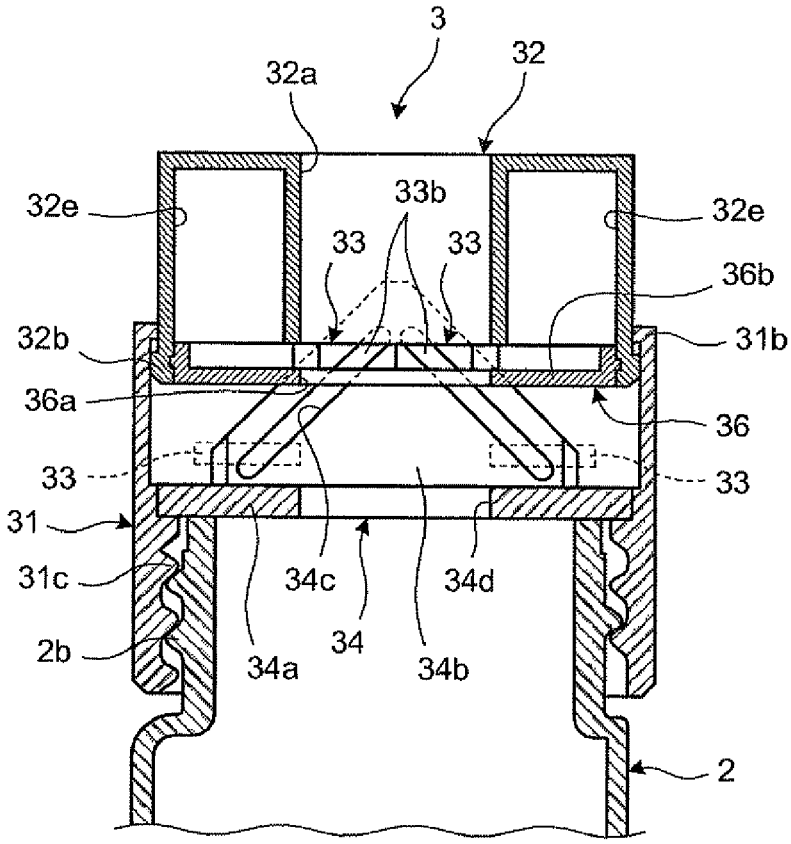
FIG. 13 is an enlarged sectional elevation view of the cap portion of the sample container shown in FIG. 2.
Figure 14:
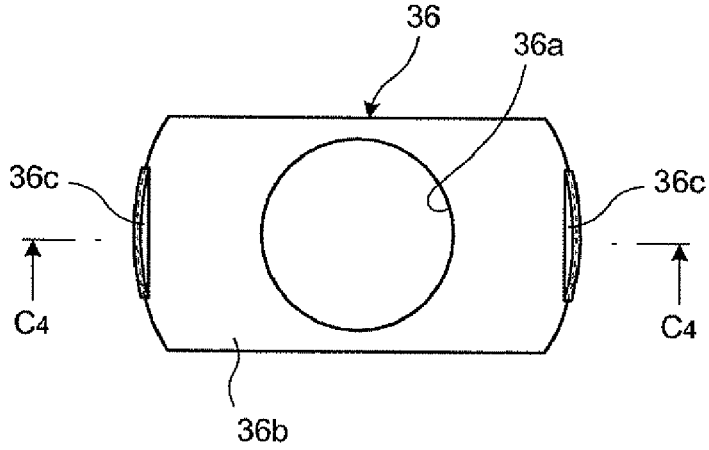
FIG. 14 is a plan view of a holding plate of the sample container.
Figure 15:
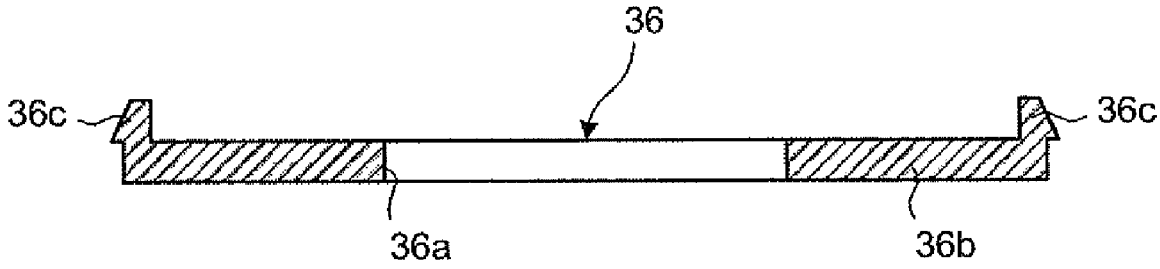
FIG. 15 is a sectional view of the holding plate along line C4-C4 of FIG. 14.
Figure 16:
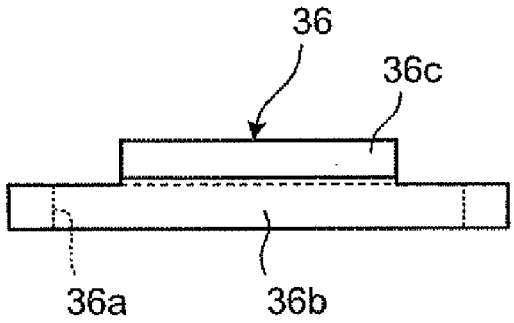
FIG. 16 is a side view of the holding plate shown in FIG. 14.

As shown in FIGS. 12 and 13, two shutters 33 are held by a holding plate 36 attached to the inner lid 32 and supported by the inner lid 32 so as to be driven integrally with the inner lid 32. In the holding plate 36, engaging bosses 36*c* projecting upward are formed on two short sides of a base plate 36*b* in which an opening 36*a* is formed at the center as shown in FIGS. 14 to 16. The holding plate 36 is fitted to the inner lid 32 with the engaging bosses 36*c* fitted into the engaging groove 32*c*, after the base plate 36*b* is placed between two support plates 34*b* of the translating unit 34 and the bosses 33*b* of each shutter 33 are made fit to the mutually opposing guiding slots 34*c*. Thus, the holding plate 36 holds two shutters 33 between the inner lid 32 and the holding plate 36 as shown in FIG. 13. Thus, the sample container 1 can integrally drive the inner lid 32 and the shutters 33 always in a stable state using the holding plate 36.

Figure 17:
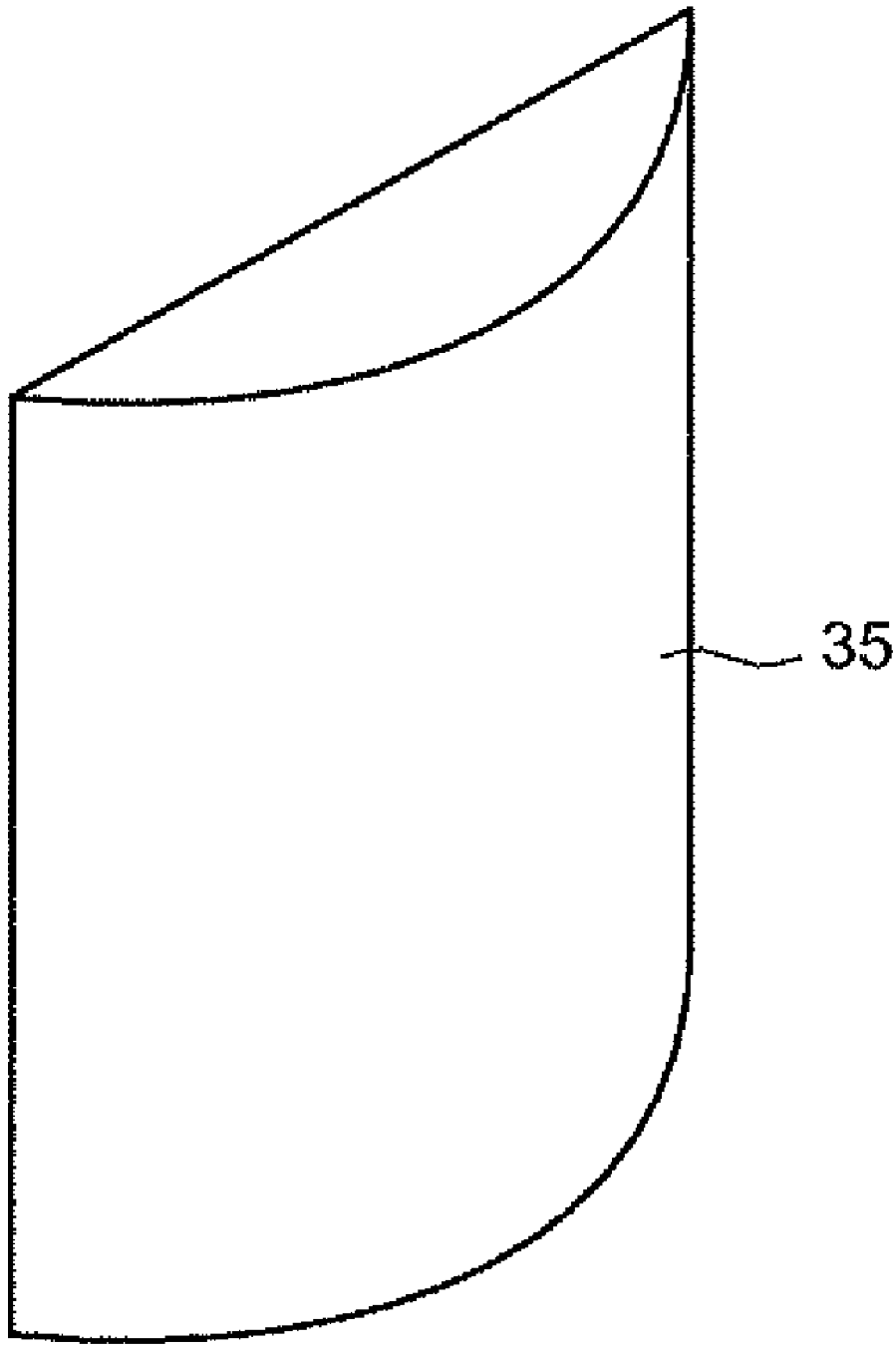
FIG. 17 is a perspective view of a pressing member of the sample container.

The pressing member 35 is formed in a columnar shape from an elastic body such as closed-cell polyurethane foam as shown in FIG. 17. The pressing members 35 are arranged in the spaces 32*f* between the outer lid 31 and the inner lid 32 as shown in FIG. 3 so as to push the inner lid 32 upward to close the shutters 33.

In the sample container 1 configured as described above, two shutters 33 contact with each other at the center so as to close the opening 32*a* of the inner lid 32 as shown in FIGS. 2, 12, and 13 because the elastic force of the pressing members 35 push the inner lid 32 and the holding plate 36 upward. Therefore, the sample container 1 can suppress the evaporation of the contained liquid sample containing a reagent and a test body.

Figure 18:
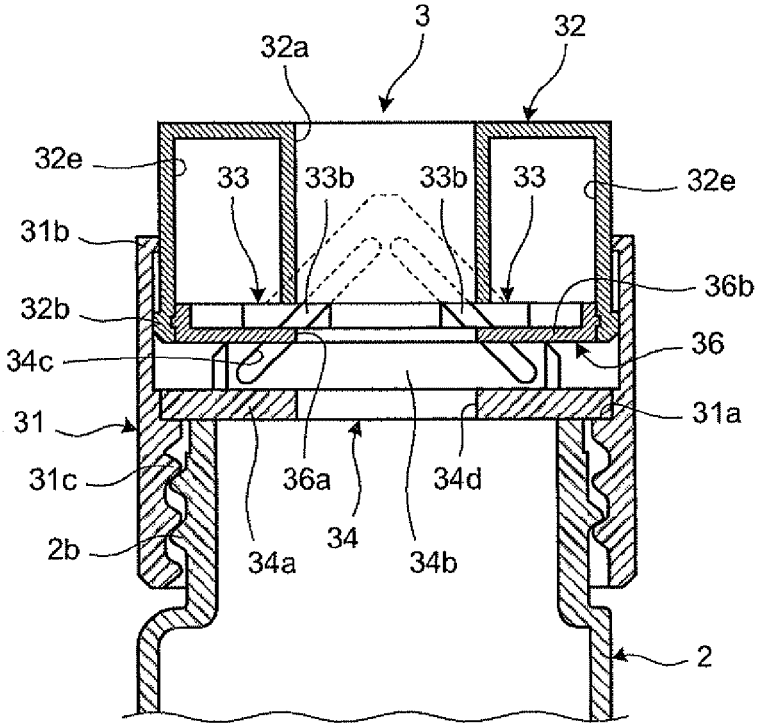
FIG. 18 is an enlarged sectional elevation view of the cap portion of the sample container with the inner lid pressed halfway down.
Figure 19:
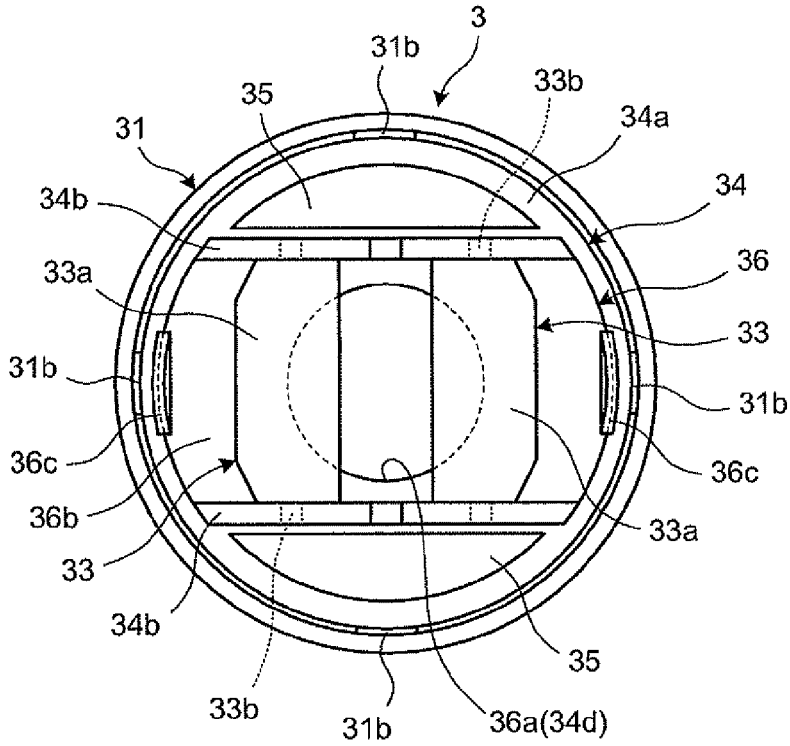
FIG. 19 is a plan view of the cap portion of the sample container shown in FIG. 18 with the upper lid removed.
Figure 20:
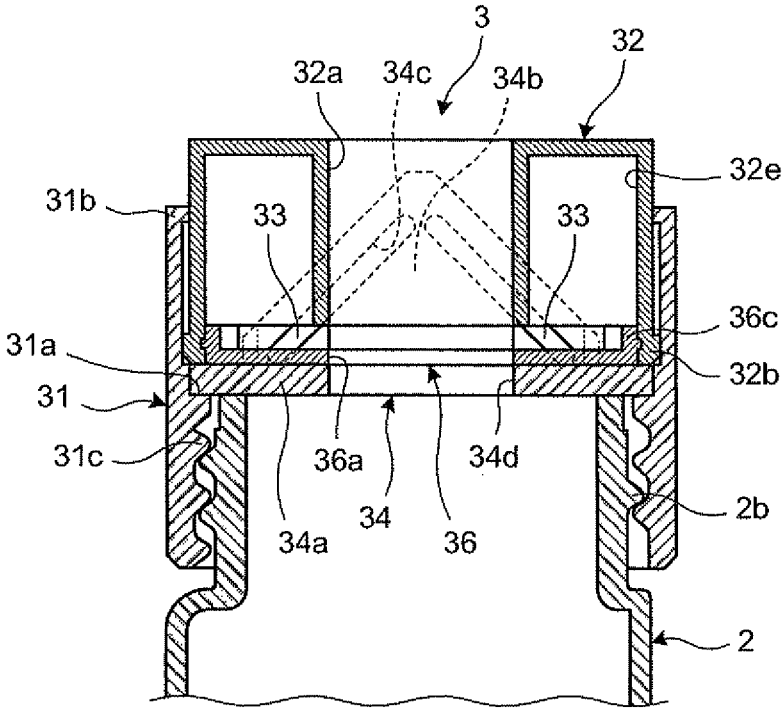
FIG. 20 is an enlarged sectional elevation view of the cap portion of the sample container with the inner lid pressed down to a lowermost position.
Figure 21:
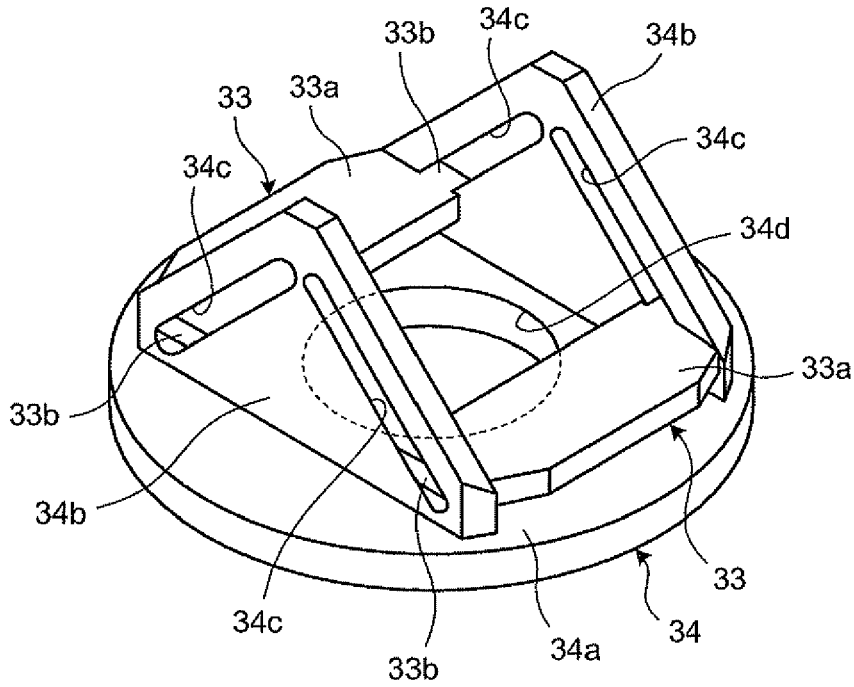
FIG. 21 is a perspective view of the two shutters fitted to the translating unit, showing position of the two shutters in a state shown in FIG. 20.
Figure 22:
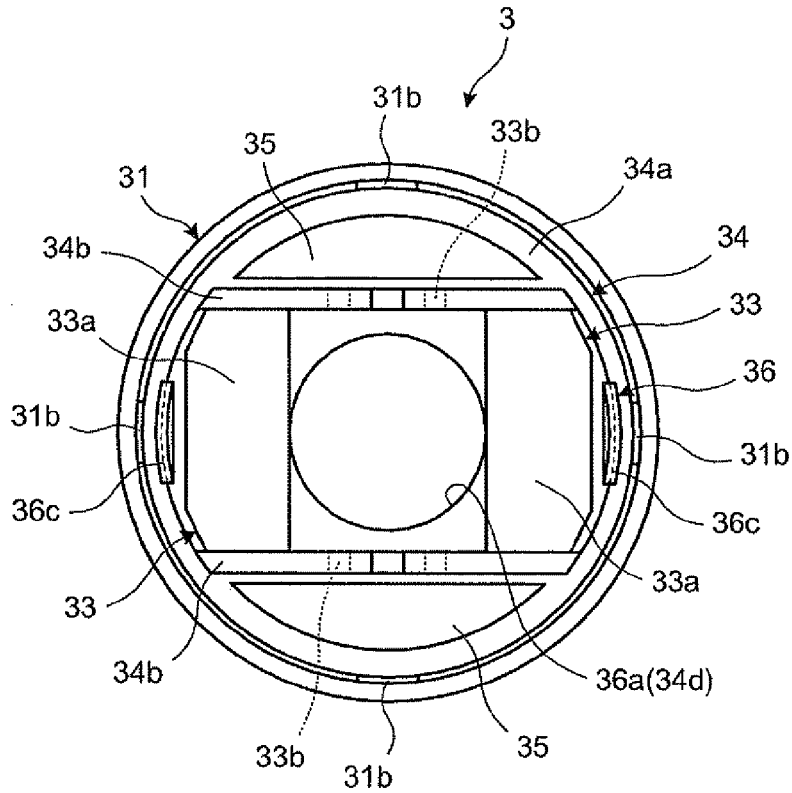
FIG. 22 is a plan view of the sample container shown in FIG. 20 with the upper lid removed.
Figure 23:
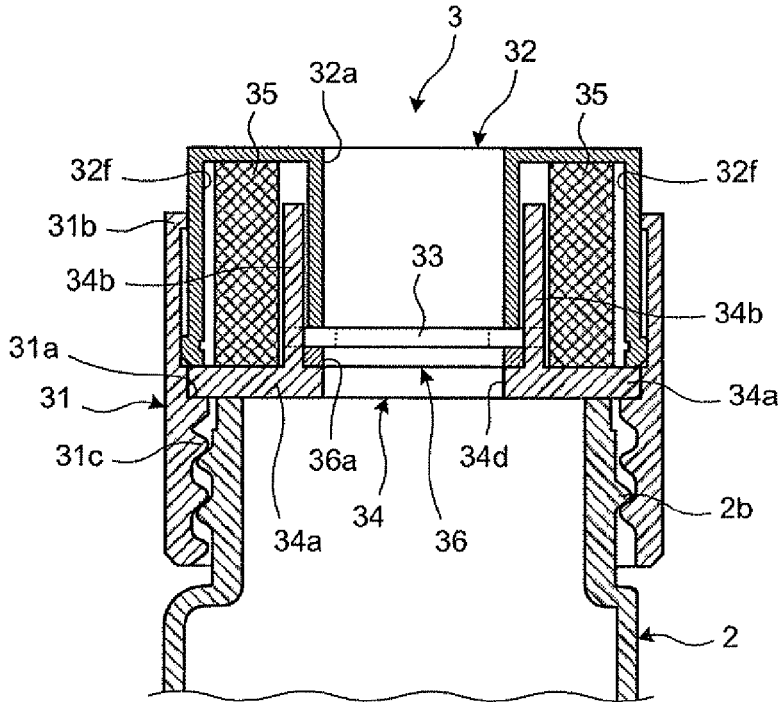
FIG. 23 is an enlarged sectional side view of the cap portion of the sample container with the inner lid pressed down to the lowermost position.

When the liquid sample is dispensed from the sample container 1, the inner lid 32 is pushed down. When the inner lid 32 is pushed halfway down in the sample container 1, the vertical sliding movement of the inner lid 32 is translated to the horizontal movements of the shutters 33 by the translating unit 34. Then, as shown in FIGS. 18 and 19, two shutters 33 are guided along the guiding slots 34*c* of the translating unit 34 and pushed down together with the inner lid 32 while distancing from each other in the horizontal direction. As a result, two shutters 33 are separated while the inner lid 32 is pushed down in the sample container 1, and the opening 32*a* is gradually opened as shown in FIG. 18. At the same time, the pressing members 35 arranged in the spaces 32*f* between the outer lid 31 and the inner lid 32 are pressed and compressed by the inner lid 32 in the sample container 1.

when the inner lid 32 is pushed down to a lowermost position in the sample container 1, the holding plate 36 is brought into contact with the upper surface of the base plate 34*a* and makes two shutters 33 distanced from each other to a maximum extent, thus the opening 32*a* is made completely open through two shutters 33 as shown in FIG. 20. In this state, the pressing member 35 is compressed to a maximum extent by the inner lid 32. FIG. 21 shows a positional relation between two shutters 33 and the translating unit 34 at a time when the inner lid 32 is pressed down to the lowermost position. As shown in FIGS. 20 and 21, when two shutters 33 are distanced from each other to the maximum extent, an interior of the container body 2 is communicated with the outside via the opening 32*a* of the inner lid 32, the opening 36*a* of the holding plate 36, and the opening 34*d* of the translating unit 34 in the sample container 1. While the sample container 1 is in this state, a dispensing nozzle (not shown) is inserted into the opening 32*a* of the inner lid 32 from above. Then, the liquid sample such as the reagent and the test body contained in the sample container 1 can be dispensed.

After the dispensing of the liquid sample is finished, the inner lid 32 is released from the pressure. Then, in the sample container 1, the inner lid 32 is pushed up due to the restoring force of the pressing member 35 which has been pressed to a maximum extent. Then, two shutters 33 in the sample container 1 are guided through the guiding slots 34*c* of the translating unit 34 and move closer to each other in the horizontal direction while moving up with the inner lid 32. Thus, the inner lid 32 and two shutters 33 move back to the position before the inner lid 32 is pressed, and two shutters 33 close the opening 32*a* of the inner lid 32 in the sample container 1. Therefore, simply by releasing the inner lid 32 from the pressure, the pressing member 35 returns the inner lid 32 to the position before the pressing, and the shutters 33 close the opening 32*a* in the sample container 1. In the sample container 1, the translating unit 34 of a simple structure can easily close and open the shutters 33.

Thus, in the sample container 1, the translating unit 34 translates the vertical sliding movements of the inner lid 32 against the outer lid 31 to the horizontal movements of two shutters 33, and the cap 3 includes only five types of parts, namely, the outer lid 31, the inner lid 32, the shutter 33, the translating unit 34, and the pressing member 35. Therefore, the sample container 1 has a simple structure and a smaller number of parts. In the sample container 1, the cap 3 can be assembled easily, and a simple, stable operation of the shutter can be realized. In addition, in the sample container 1, the shutter 33 operates inside the cap 3*r* and does not move outside the cap 3, more particularly, outside the container body 2 when viewed from above the sample container 1. Thus, the space for the arrangement of the sample container 1 can be suppressed. Even when plural sample containers are placed next to each other, for example, when used in the automatic analyzer, each sample container 1 does not interfere with other sample containers during use.

In the sample container 1 of the present invention, means for pressing the inner lid 32 upward to close the shutters 33 may be a coil spring other than the pressing member 35.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sample container comprising:

a cap that covers a container body holding a liquid sample containing a reagent and a test body, the cap including, an outer lid that covers the container body, an inner lid that is slidably attached to the outer lid and has an opening for dispensing the liquid sample, a shutter that is driven integrally with the inner lid and covers the opening of the inner lid so that the opening can be opened and closed, a translating unit that is attached to the outer lid and has an engaging portion which is formed obliquely descending from a center of the cap to an outer edge of the cap and to which the shutter is fitted, and a pressing member that is arranged between the outer lid and the inner lid to press the inner lid to close the shutter, wherein the translating unit translates sliding movement of the inner lid to a movement of the shutter in a direction perpendicular to the sliding movement to open and close the opening of the inner lid.

2. The sample container according to claim 1, wherein the shutter is held by a holding plate attached to the inner lid so that the shutter can be driven integrally with the inner lid.

* * * * *